US006634106B2

(12) United States Patent
Yeh

(10) Patent No.: US 6,634,106 B2
(45) **Date of Patent: *Oct. 21, 2003**

(54) HAIRDRESSING SCISSOR ASSEMBLY HAVING DETACHABLE DOVETAIL CONNECTION

(76) Inventor: Wen-Ya Yeh, Suite 2, 15th Floor, No. 18, Chuney-Hsueh Road, Tainan (TW)

( * ) Notice: Subject to any disclaimer, the term of this patent is extended or adjusted under 35 U.S.C. 154(b) by 144 days.

This patent is subject to a terminal disclaimer.

(21) Appl. No.: 09/955,276

(22) Filed: Sep. 18, 2001

(65) Prior Publication Data

US 2003/0051349 A1 Mar. 20, 2003

(51) Int. Cl.[7] ..... B26B 13/00
(52) U.S. Cl. ..... 30/226; 30/227; 30/254
(58) Field of Search ..... 30/226, 227, 254

(56) References Cited

U.S. PATENT DOCUMENTS

| | | | | |
|---|---|---|---|---|
| 184,914 A | | 11/1876 | Scripps | 30/226 |
| 550,483 A | | 11/1895 | Carrier | |
| 1,012,918 A | | 12/1911 | Roelants et al. | 30/226 |
| 1,715,898 A | | 6/1929 | Carri | |
| 2,272,580 A | | 2/1942 | Phillips | |
| 2,456,858 A | | 12/1948 | Bolling | |
| 2,840,905 A | | 7/1958 | Geiger | |
| D267,996 S | | 2/1983 | Kowalski | 30/226 |
| 4,676,762 A | * | 6/1987 | Ballard | 446/104 |
| 5,600,891 A | | 2/1997 | Orgal | 30/226 |
| 5,775,046 A | * | 7/1998 | Fanger et al. | 52/590.1 |
| 5,875,553 A | | 3/1999 | Geib, Jr. et al. | 30/226 |
| 5,996,592 A | * | 12/1999 | Choy | 132/200 |
| 6,192,590 B1 | | 2/2001 | Yeh | 30/226 |

FOREIGN PATENT DOCUMENTS

| | | |
|---|---|---|
| DE | 1918677 | 10/1970 |
| DE | 19963222 | 6/2001 |
| GB | 1537614 | 1/1979 |
| GB | 2315037 | 1/1998 |
| GB | 2337721 | 1/1999 |

OTHER PUBLICATIONS

Houser et al., Cable Slitter, IBM technical disclosure bulletin, vol. 13 No. 10, Mar. 1971.

* cited by examiner

*Primary Examiner*—Allan N. Shoap
*Assistant Examiner*—John Windmuller
(74) *Attorney, Agent, or Firm*—Alan D. Kamrath; Rider Bennett, LLP.

(57) ABSTRACT

A pair of hairdressing scissors comprises two cutting members pivotally connected together. Each cutting member comprises a handle at a first end thereof and a blade at a second end thereof. A through-hole is defined in at least one of the handles. A connecting block is securely mounted in the through-hole and comprises a dovetail groove in a first side thereof and a dovetail block in a second side thereof. The dovetail block of the connecting block of one pair of hairdressing scissors is releasably engaged with the dovetail groove of the connecting block of another pair of hairdressing scissors.

6 Claims, 14 Drawing Sheets

HAIRDRESSING SCISSOR ASSEMBLY HAVING DETACHABLE DOVETAIL CONNECTION

BACKGROUND OF THE INVENTION

1. Field of the Invention

The present invention relates to a hairdressing scissor assembly comprising plural pairs of scissors that are detachably engaged together by detachable dovetail connection to proceed with special haircutting.

2. Description of the Related Art

A hairstylist cuts a customer's hair with several techniques, including trimming, thinning, layering, etc. Sometimes the hairstylist has to hold plural pairs of scissors in the same hand for proceeding with the thinning or layering of the hair to obtain the desired special hairstyle.

During operation of the plural pairs of scissors in the same hand, the user must keep the plural pairs of scissors be spaced at regular intervals and operate them with the same operating condition. The plural pairs of scissors must open and close synchronously to obtain a tidy, beautiful hairstyle. However, the plural pairs of scissors are simply held by the index finger and the thumb of the user such that the plural pairs of scissors cannot be operated synchronously due to touchy control of the plural pairs of scissors by the fingers. Thus, the plural pairs of scissors often become skew to one another and the spacing therebetween may be different from one another. The haircutting result is adversely affected, and this problem is aggravated if the user is inexperienced. The user often feels pain when operating the plural pairs of scissors in addition to numerous limitations to and difficulties in operation.

U.S. Pat. No. 6,192,590 to Applicant issued on Feb. 27, 2001 and Applicant's U.S. patent application Ser. No. 09/617,713 disclose hairdressing scissor assemblies to solve the above-mentioned problems. However, formation of the L-shaped engaging member and the L-shaped slot of the connecting block for connecting the plural pairs of scissors is troublesome and costly.

SUMMARY OF THE INVENTION

An object of the present invention is to provide a hairdressing scissor assembly comprising plural pairs of scissors that are detachably engaged together by detachable dovetail connection to proceed with special haircutting.

A hairdressing scissor assembly in accordance with the present invention comprises plural pairs of hairdressing scissors. Each pair of hairdressing scissors comprises two cutting members pivotally connected together. Each cutting member comprises a handle at a first end thereof and a blade at a second end thereof. A through-hole is defined in at least one of the handles. A connecting block is securely mounted in the through-hole and comprises a dovetail groove in a first side thereof and a dovetail block in a second side thereof. The dovetail block of the connecting block of one pair of hairdressing scissors is releasably engaged with the dovetail groove of the connecting block of another pair of hairdressing scissors.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
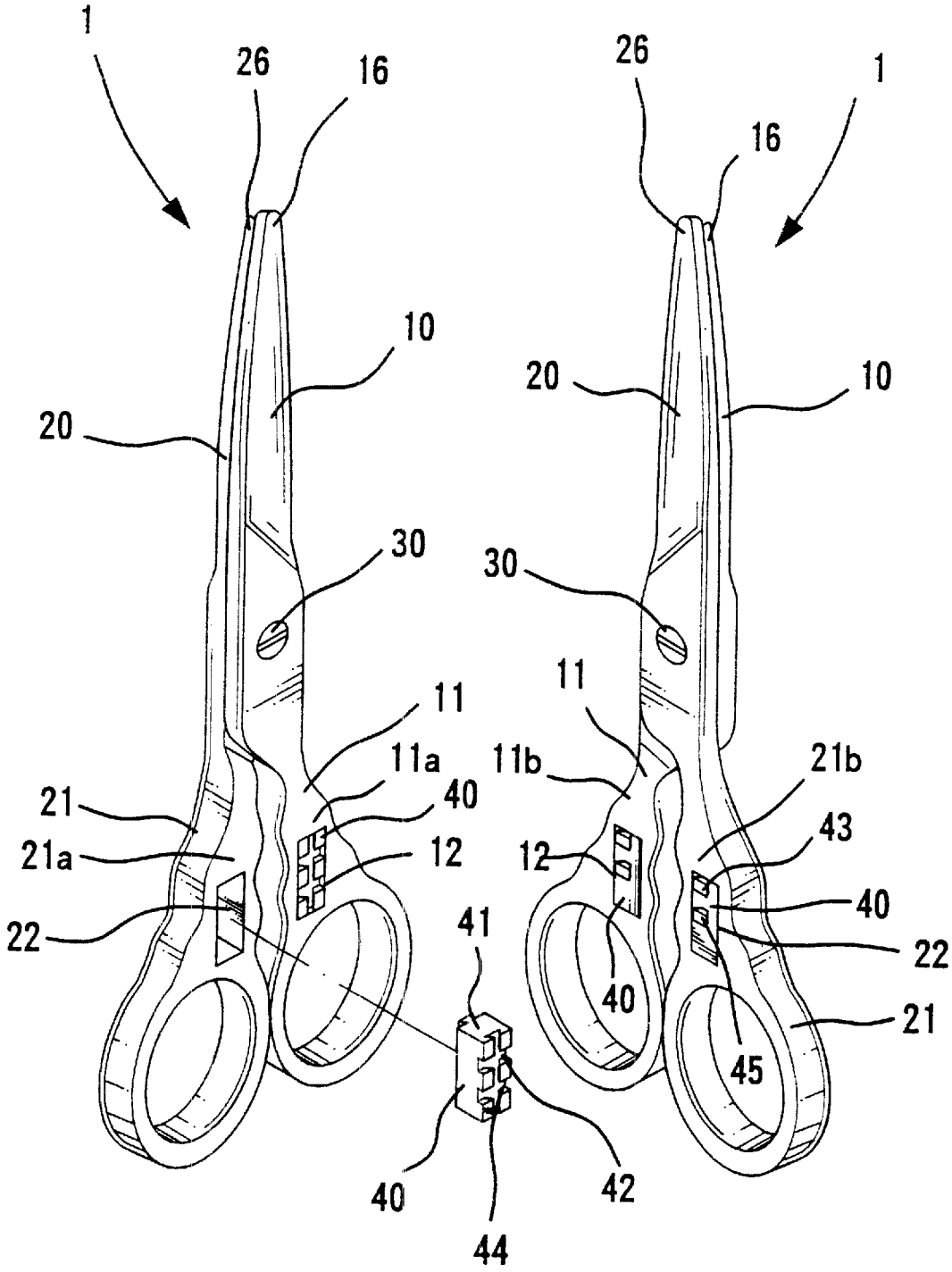
FIG. 1 is an exploded perspective view of a first embodiment of a hairdressing scissor assembly in accordance with the present invention.

Referring to FIG. 1, a first embodiment of a hairdressing scissor assembly in accordance with the present invention generally comprises plural pairs of scissors 1 each having first and second cutting members that are pivoted together by a pivot 30. The first cutting member comprises a first handle 11 on an end thereof and a first blade 10 on the other end thereof. The second cutting member comprises a second handle 21 on an end thereof and a second blade 20 on the other end thereof. Each blade 10, 20 has a tip 16, 26. The first and second cutting members are pivoted together at intermediate portions thereof. Of course, each handle 11, 21 has an opening (not labeled) for the thumb or index finger of the user.

At least one of the first handle 11 and the second handle 21 has a through-hole 12 defined therein and extending from a first side 11*a*, 21*a* to a second side 11*b*, 21*b* opposite to the first side 11*a*, 21*a*. At least one connecting block 40 is securely mounted in the through-hole 12 to allow engagement of two pairs of scissors 1. In this embodiment, each of the first handle 11 and the second handle 21 has a through-hole 12 defined therein for receiving a respective connecting block 40.

Figure 2:
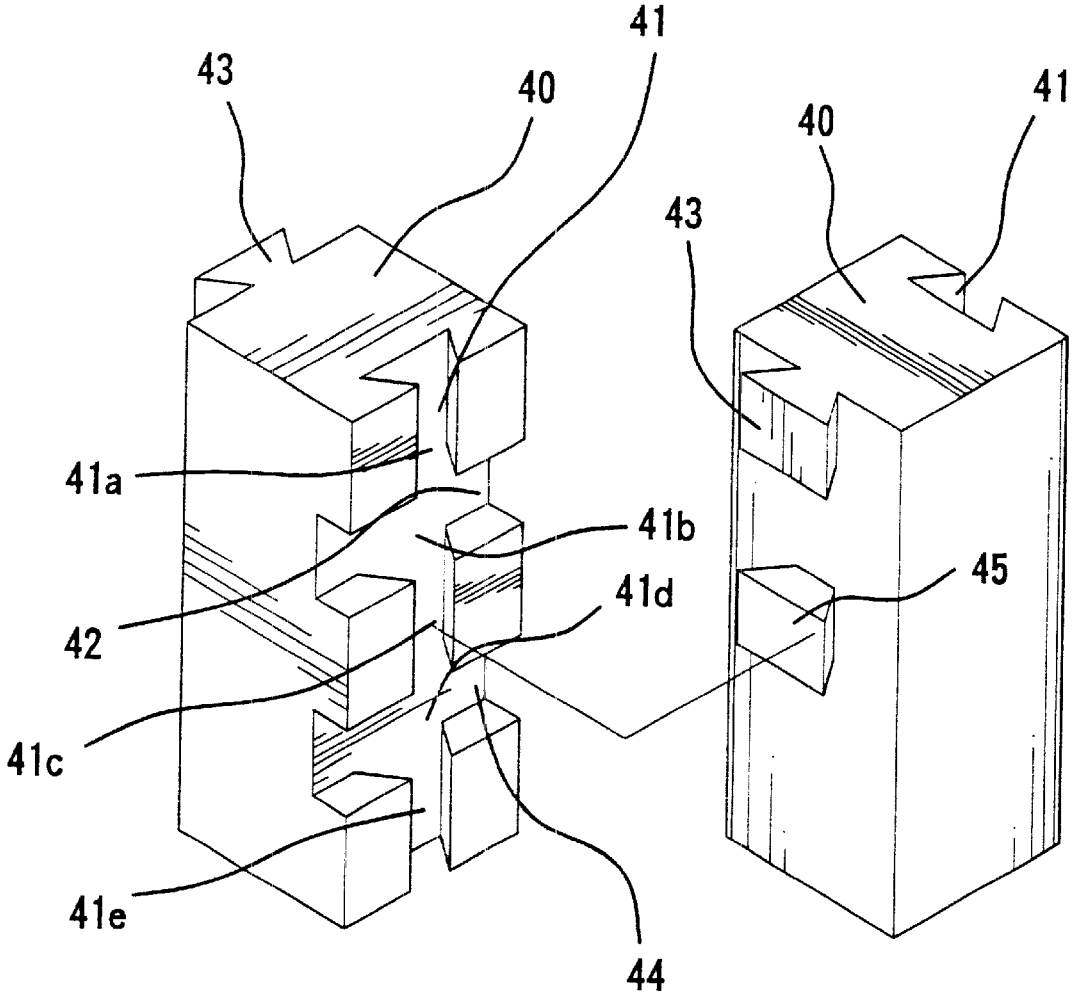
FIG. 2 is a perspective view of two connecting blocks respectively of two pairs of hairdressing scissors in FIG. 1.

Referring to FIG. 2, each connecting block 40 comprises a dovetail groove 41 in a first side thereof and two dovetail blocks 43 and 45 formed on a second side thereof opposite to the first side. In addition, two spaced transverse grooves 42 are defined in the first side of each connecting block 40 and intersect with the dovetail groove 41, thereby dividing the dovetail groove 41 into a first engaging section 41*a,* a first insertion section 41*b,* a second engaging section 41*c,* a second insertion section 41*d,* and a third engaging section 41*e* in sequence. When each connecting block 40 is mounted in the respective through-hole 12, the dovetail blocks 43 and 45 protrude beyond the second side 11*b*, 21*b* of the respective handle 11, 21 while the first side of the connecting block 40 is flush with the first side 11*a,* 21*a* of the respective handle 11, 21, best shown in FIG. 1.

Figure 3:
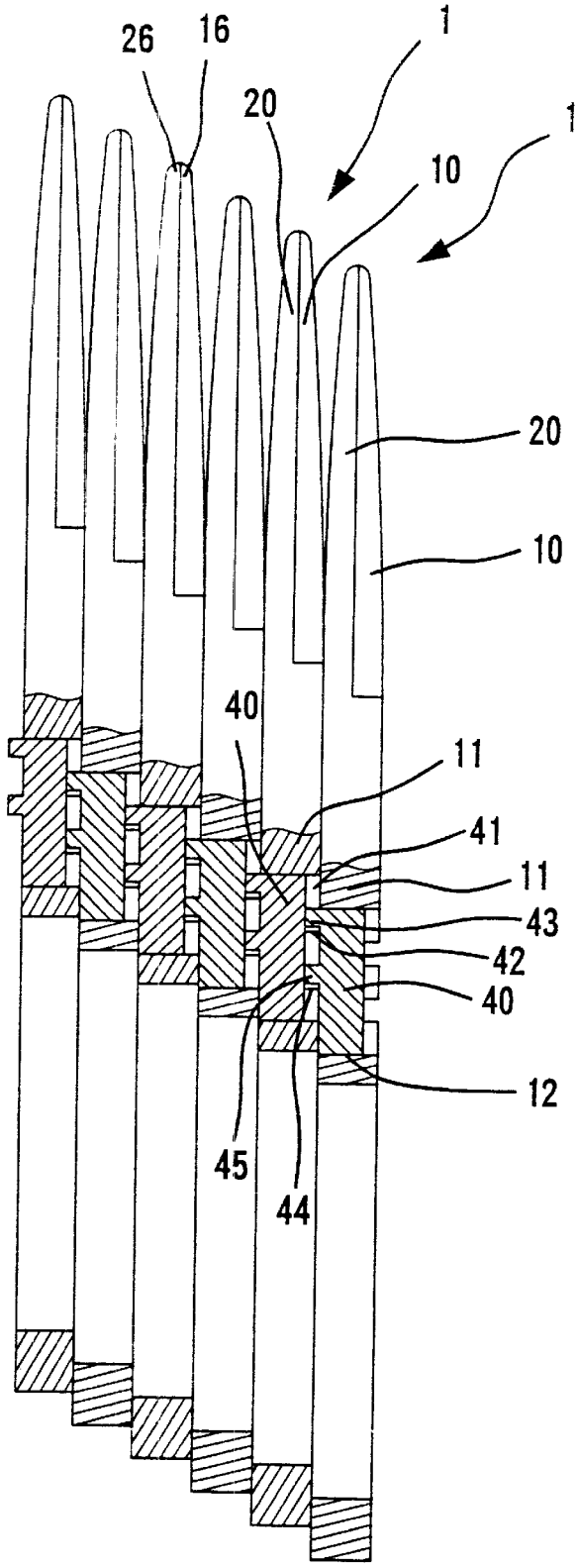
FIG. 3 is a side view, partly sectioned, illustrating the assembly procedure of the first embodiment of the hairdressing scissor assembly in FIG. 1.
Figure 4:
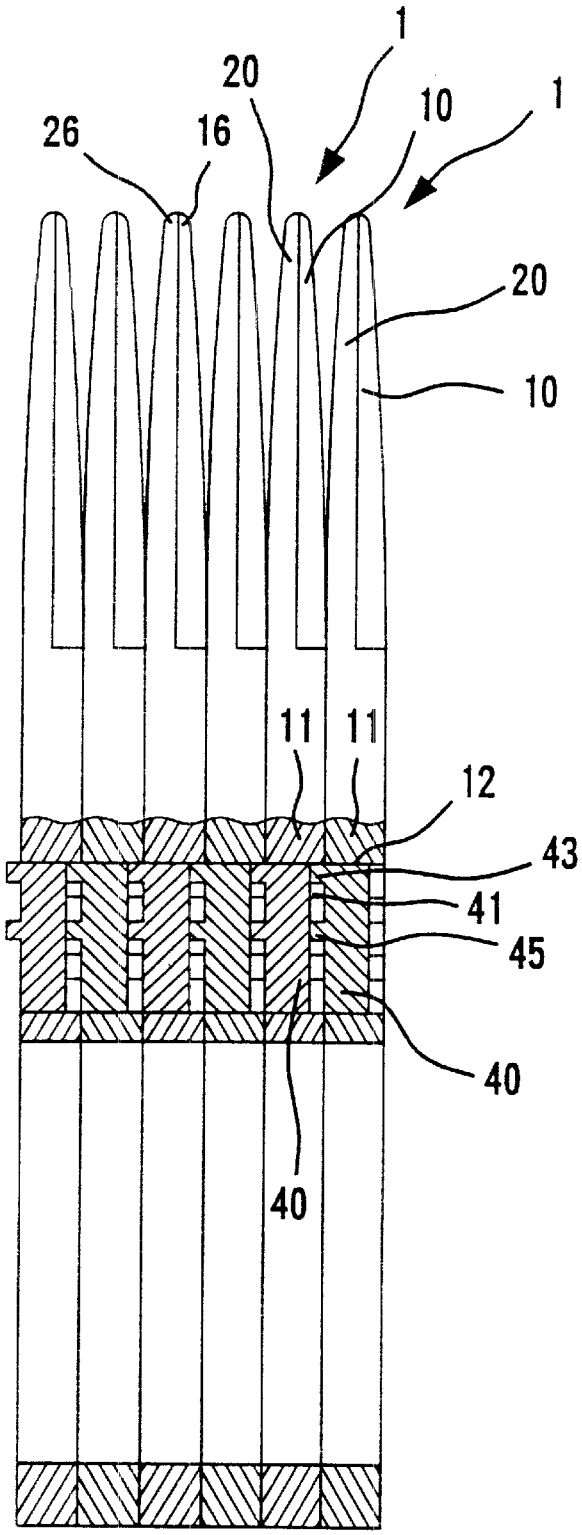
FIG. 4 is a side view similar to FIG. 3, wherein the tips of the scissors are aligned along a straight line and located at the same level.
Figure 5:
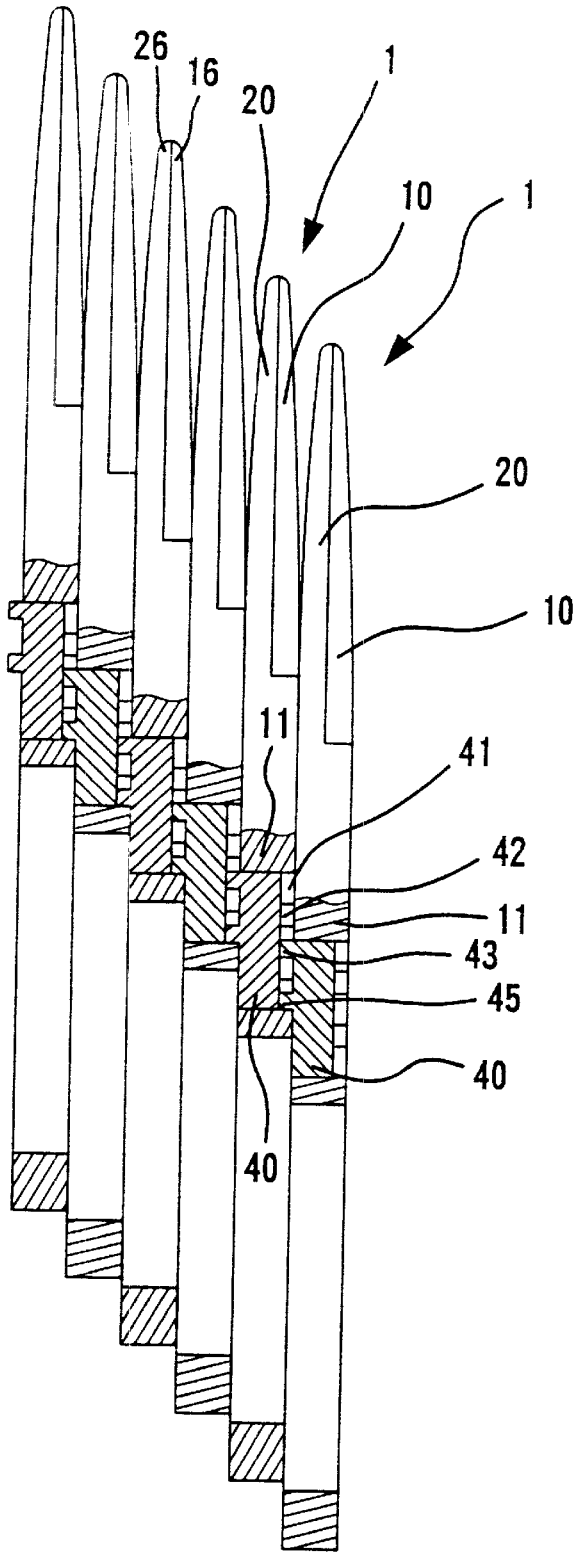
FIG. 5 is a view similar to FIG. 3, wherein the tips of scissors are aligned along an inclined line and located at different levels.

When engaging one pair of scissors 1 with another pair of scissors 1, the dovetail blocks 43 and 45 of each connecting block 40 of one pair of scissors 1 are respectively inserted into the insertion grooves 41*b* and 41*d* of the respective connecting block 40 of another pair of scissors 1, as shown in FIG. 3. Then, the right one of two adjacent pairs of scissors 1 may be moved upward relative to the left one of the two adjacent pairs of scissors 1 until the dovetail blocks 43 and 45 of each connecting block 40 of the right one of the two adjacent pairs of scissors 1 are engaged with and thus retained in the first and second engaging sections 41*a* and 41*c* of the respective connecting block 40 of the left one of the two adjacent pairs of scissors 1, thereby forming a hairdressing scissor assembly shown in FIG. 4, in which the tips 16 and 26 of the hairdressing scissors 1 are aligned along a straight line and located at the same level. Alternatively, the right one of two adjacent pairs of scissors I may be moved downward relative to the left one of the two adjacent pairs of scissors 1 until the dovetail blocks 43 and 45 of each connecting block 40 of the right one of the two adjacent pairs of scissors 1 are engaged with and thus retained in the second and third second engaging sections 41*c* and 41*e* of the respective connecting block 40 of the left one of the two adjacent pairs of scissors 1, thereby forming a hairdressing scissor assembly shown in FIG. 5, in which the tips 16 and 26 of the hairdressing scissors 1 are aligned along an inclined line and located at different levels.

Figure 6:
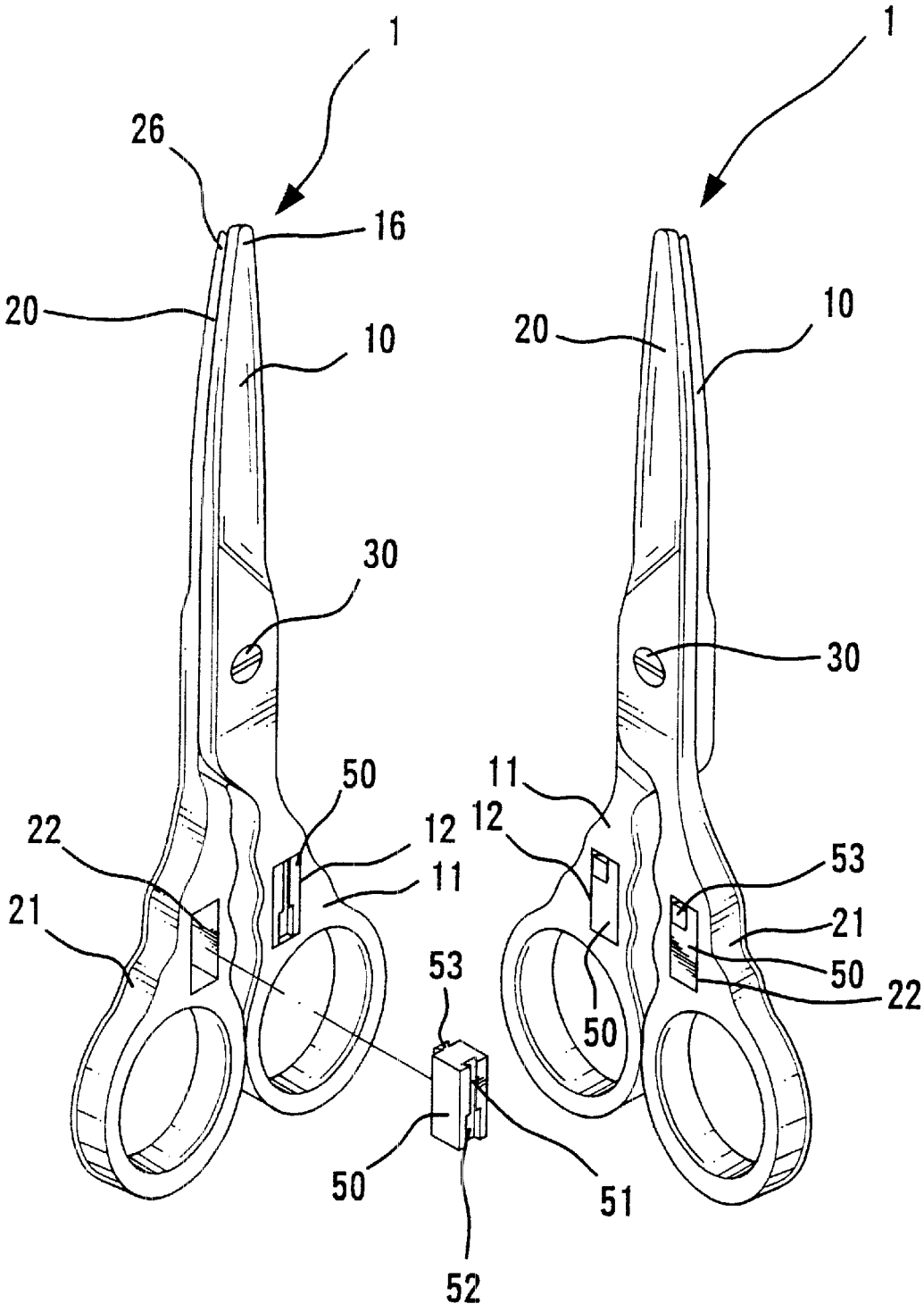
FIG. 6 is an exploded perspective view of a second embodiment of the hairdressing scissor assembly in accordance with the present invention.
Figure 7:
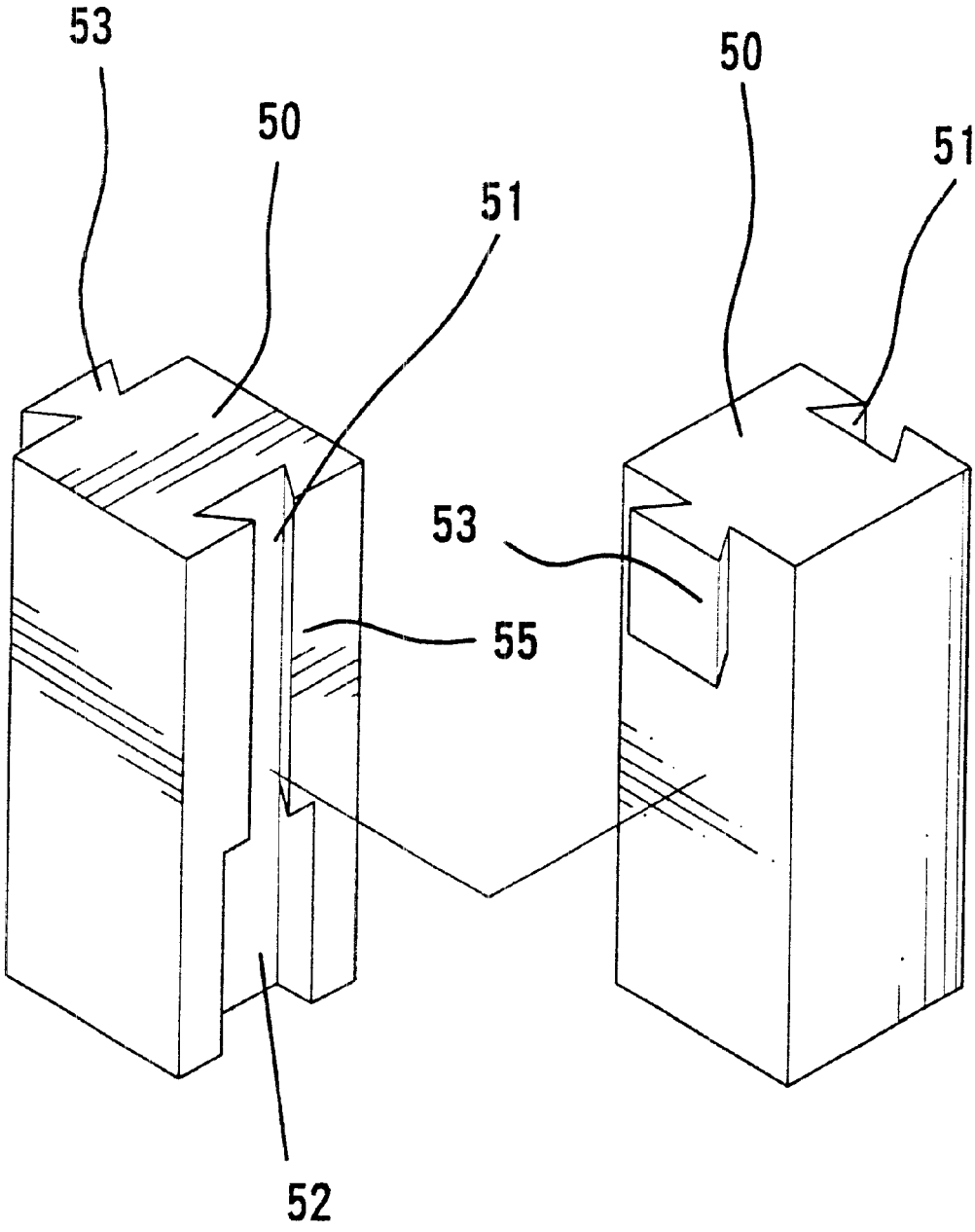
FIG. 7 is a perspective view of two connecting blocks respectively of two pairs of hairdressing scissors in FIG. 6.
Figure 8:
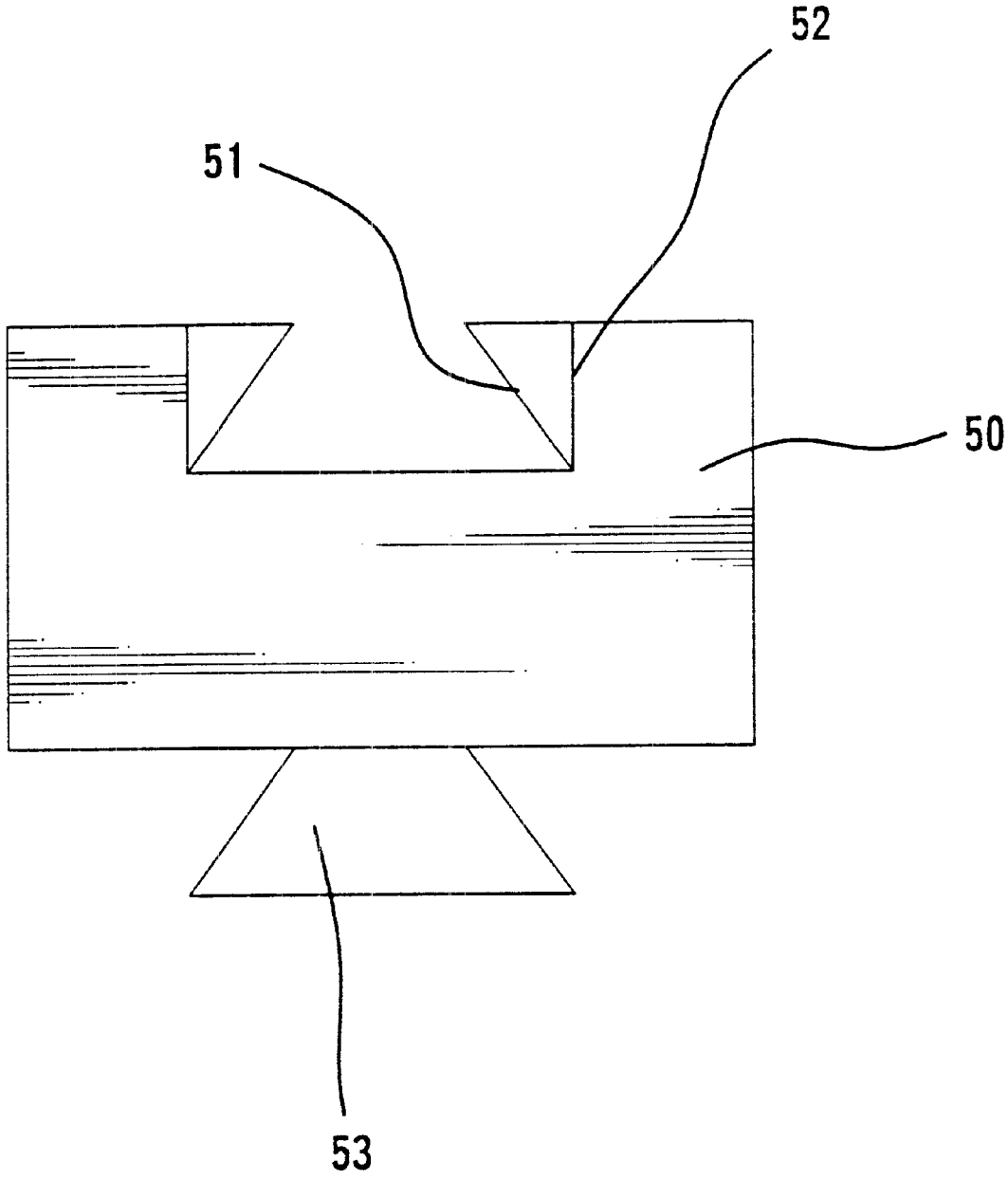
FIG. 8 is a bottom view of the connecting block in FIG. 7.

FIG. 6 illustrates a second embodiment of the hairdressing scissor assembly which differs from the first embodiment in the connecting block. In this embodiment, as illustrated in FIG. 7, each connecting block (now designated by 50) comprises a dovetail groove 51 in a first side thereof and a dovetail block 53 formed on an upper end of a second side thereof opposite to the first side. The dovetail groove 51 comprises a dovetail engaging section 55 and an insertion section 52 located below the dovetail engaging section 55 and having a width the same as the maximum width of the dovetail engaging section 55, as shown in FIG. 8.

Figure 9:
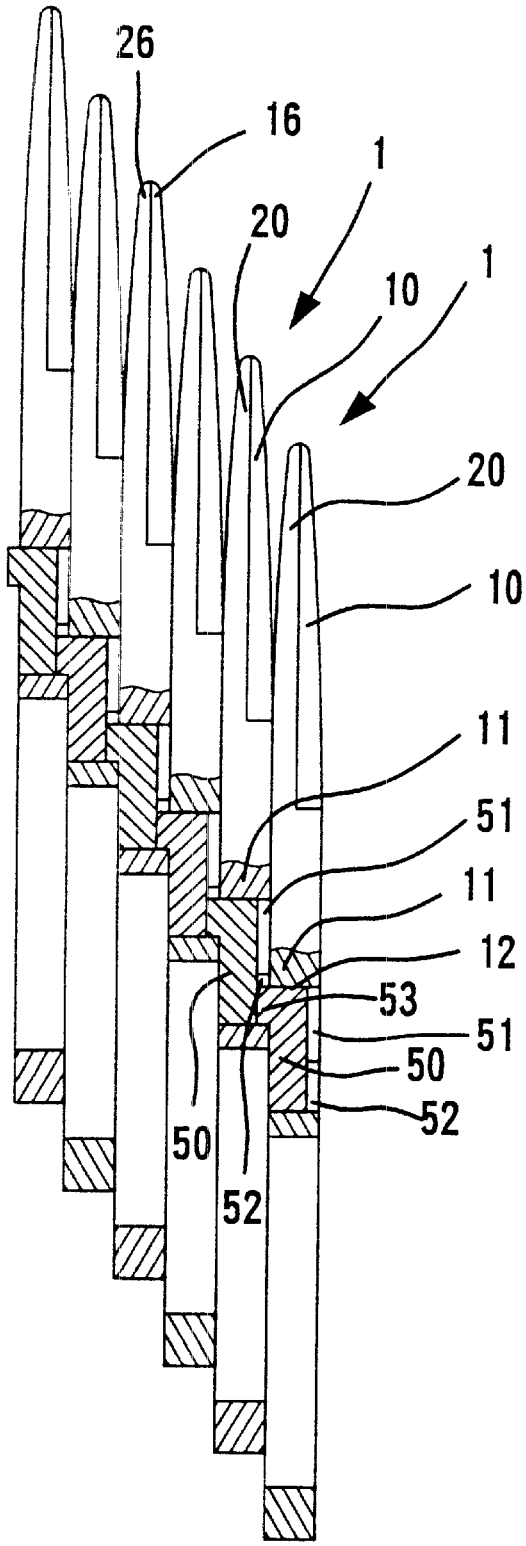
FIG. 9 is a side view, partly sectioned, illustrating the assembly procedure of the hairdressing scissor assembly in FIG. 6.
Figure 10:
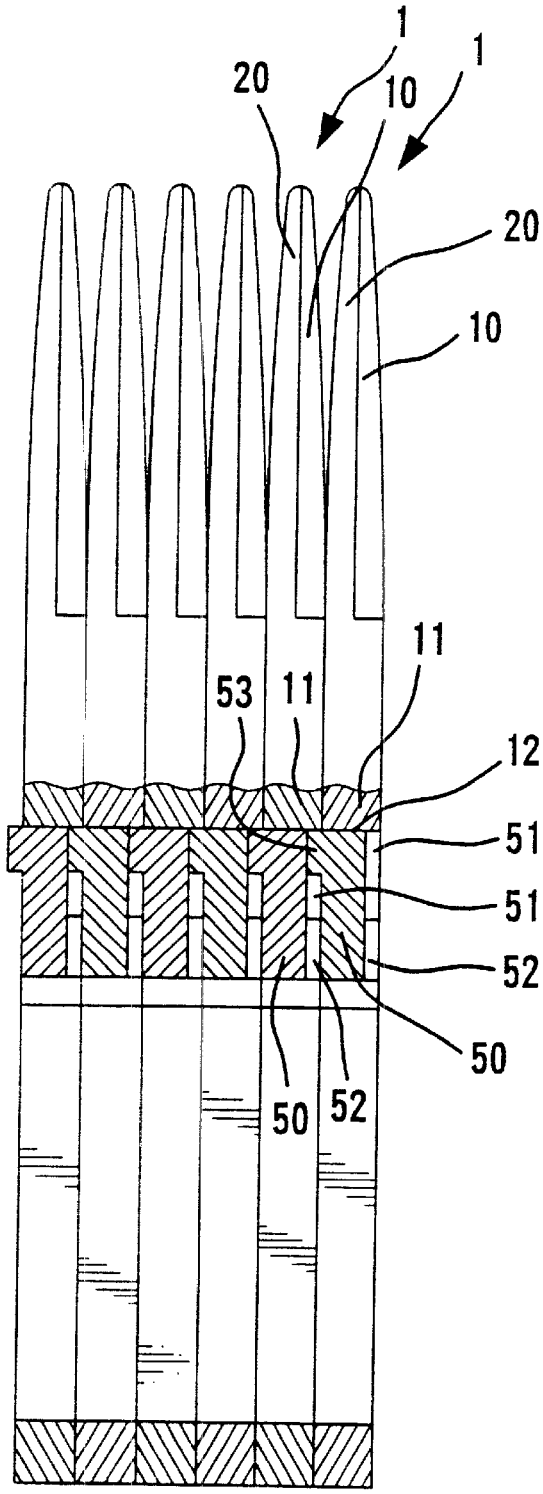
FIG. 10 is a side view similar to FIG. 9, wherein the tips of scissors are aligned along a straight line and located at the same level.

When engaging one pair of scissors 1 with another pair of scissors 1, the dovetail block 53 of each connecting block 50 of one pair of scissors 1 is inserted into the insertion groove 52 of the respective connecting block 50 of another pair of scissors 1, as shown in FIG. 9. Then, the right one of two adjacent pairs of scissors 1 may be moved upward relative to the left one of the two adjacent pairs of scissors 1 until the dovetail block 53 of each connecting block 50 of the right one of the two adjacent pairs of scissors 1 are engaged with and thus retained in the dovetail engaging section 55 of the respective connecting block 50 of the left one of the two adjacent pairs of scissors 1, thereby forming a hairdressing scissor assembly shown in FIG. 10, in which the tips 16 and 26 of the hairdressing scissors 1 are aligned along a straight line and located at the same level.

Figure 11:
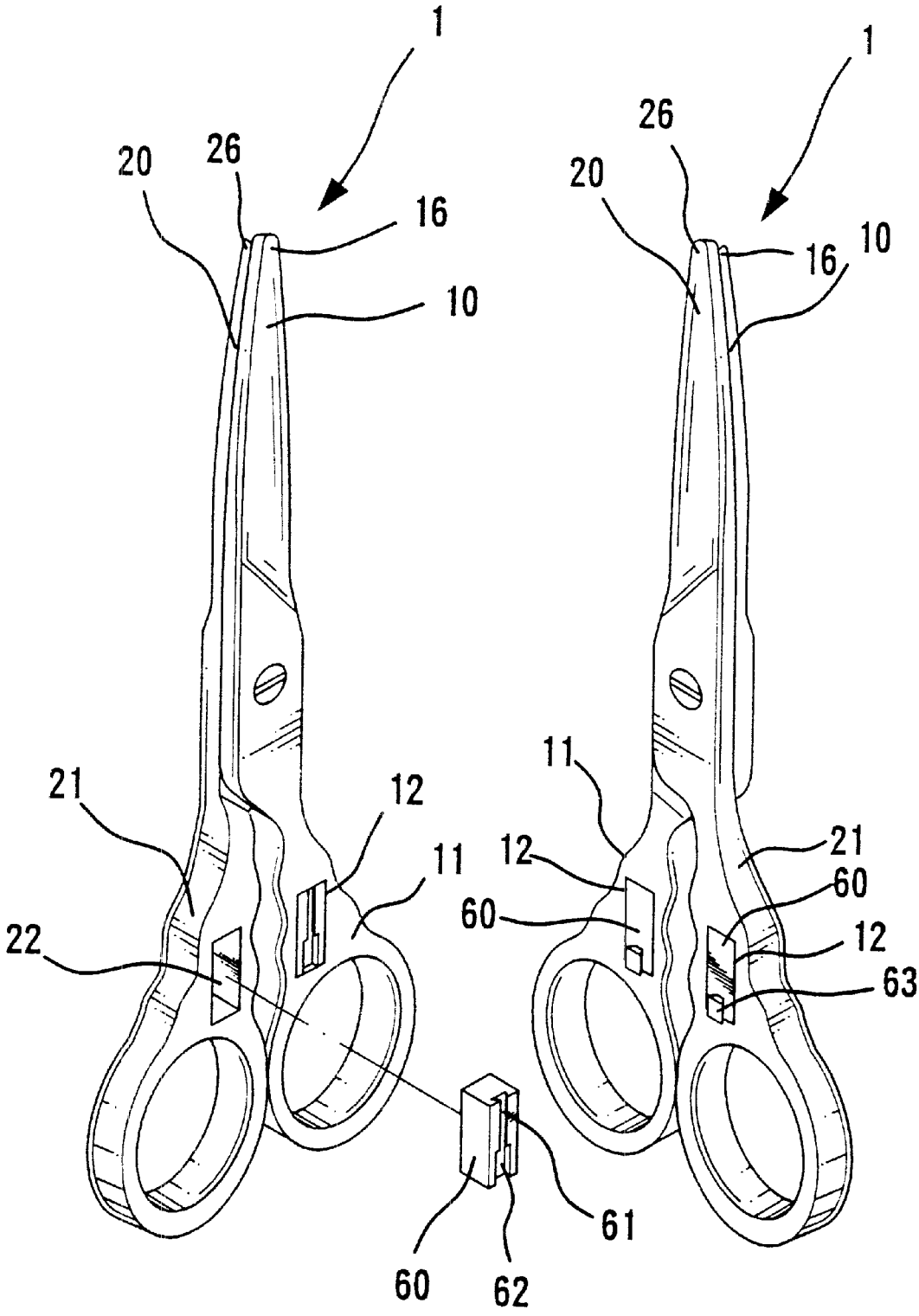
FIG. 11 is an exploded perspective view of a third embodiment of the hairdressing scissor assembly in accordance with the present invention.
Figure 12:
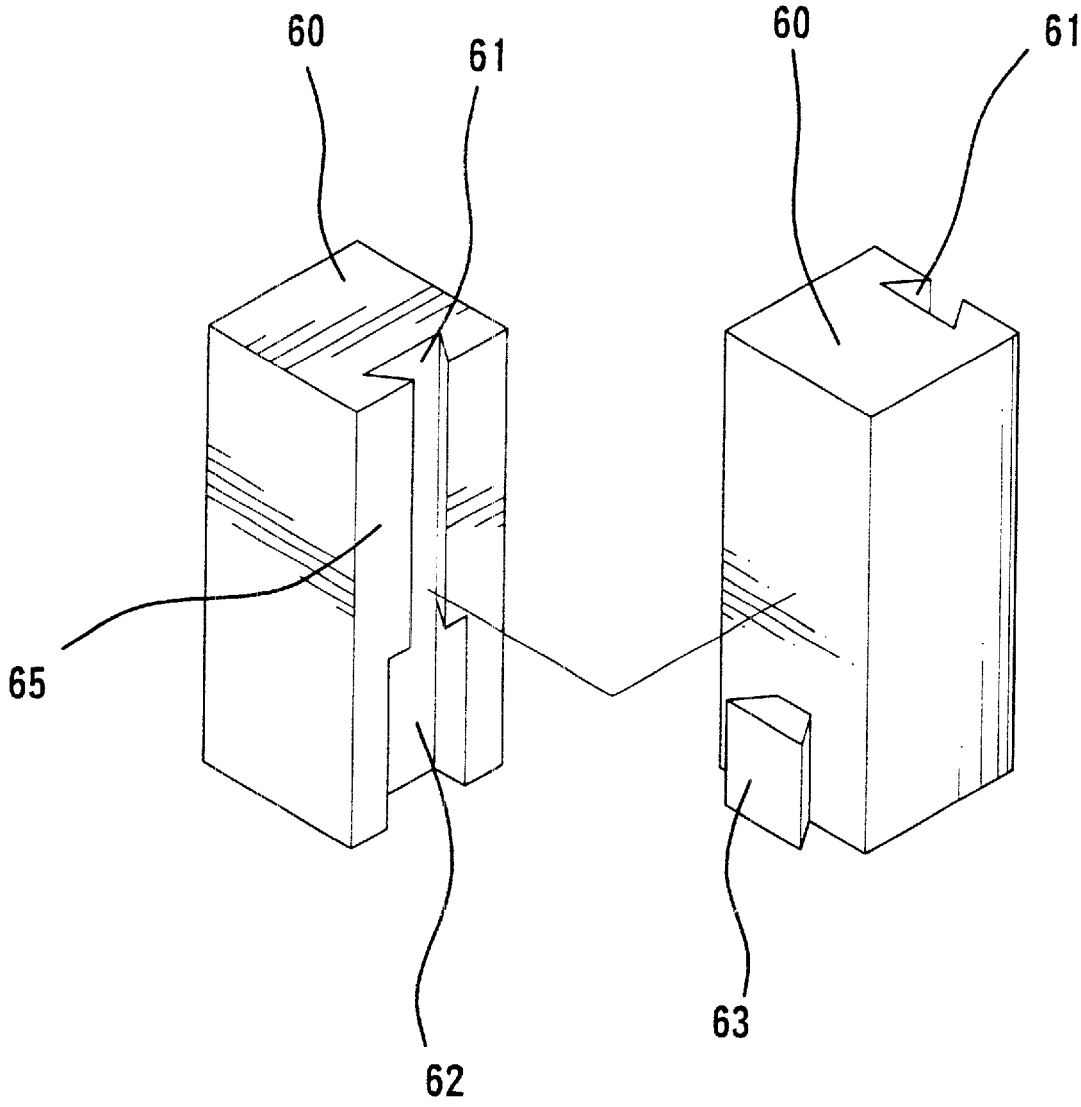
FIG. 12 is a perspective view of two connecting blocks respectively of two pairs of hairdressing scissors in FIG. 11.

FIG. 11 illustrates a third embodiment of the hairdressing scissor assembly which differs from the second embodiment in the connecting block. In this embodiment, as illustrated in FIG. 12, each connecting block (now designated by 60) comprises a dovetail groove 61 in a first side thereof and a dovetail block 63 formed on a lower end of a second side thereof opposite to the first side. The dovetail groove 61 comprises a dovetail engaging section 65 and an insertion section 62 located above the dovetail engaging section 62 and having a width the same as the maximum width of the dovetail engaging section 65.

Figure 13:
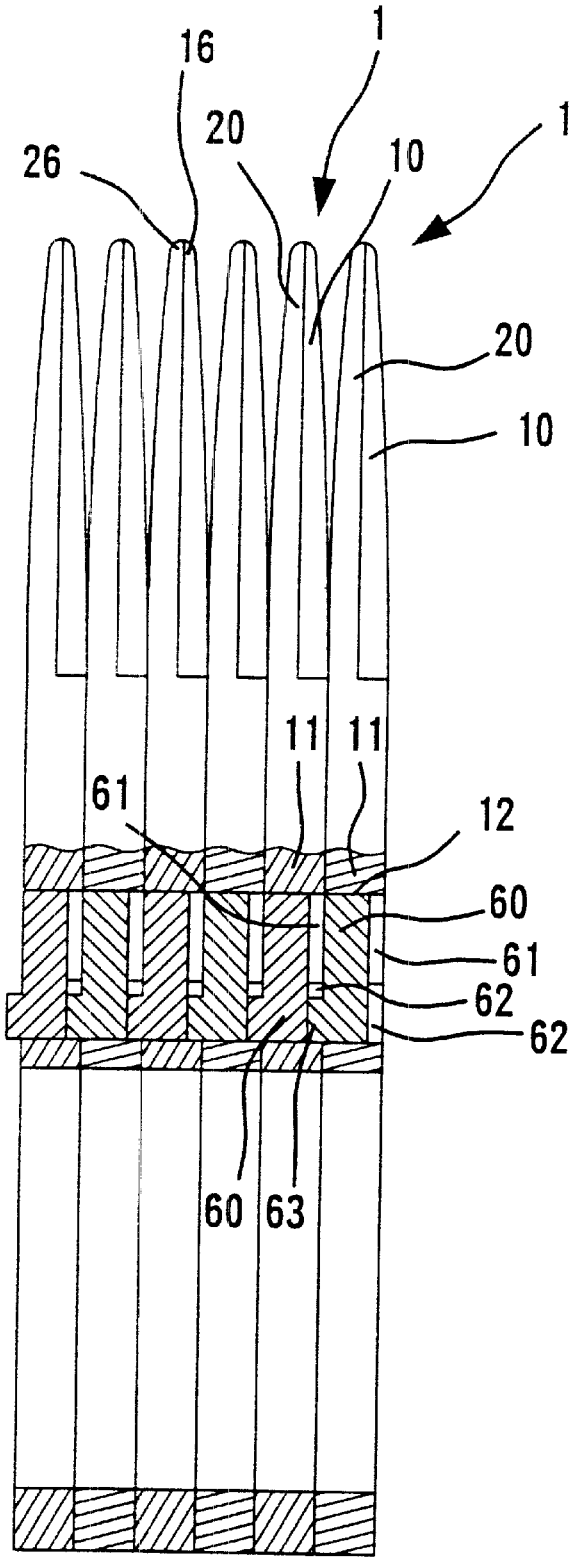
FIG. 13 is a side view, partly sectioned, illustrating the assembly procedure of the hairdressing scissor assembly in FIG. 11.
Figure 14:
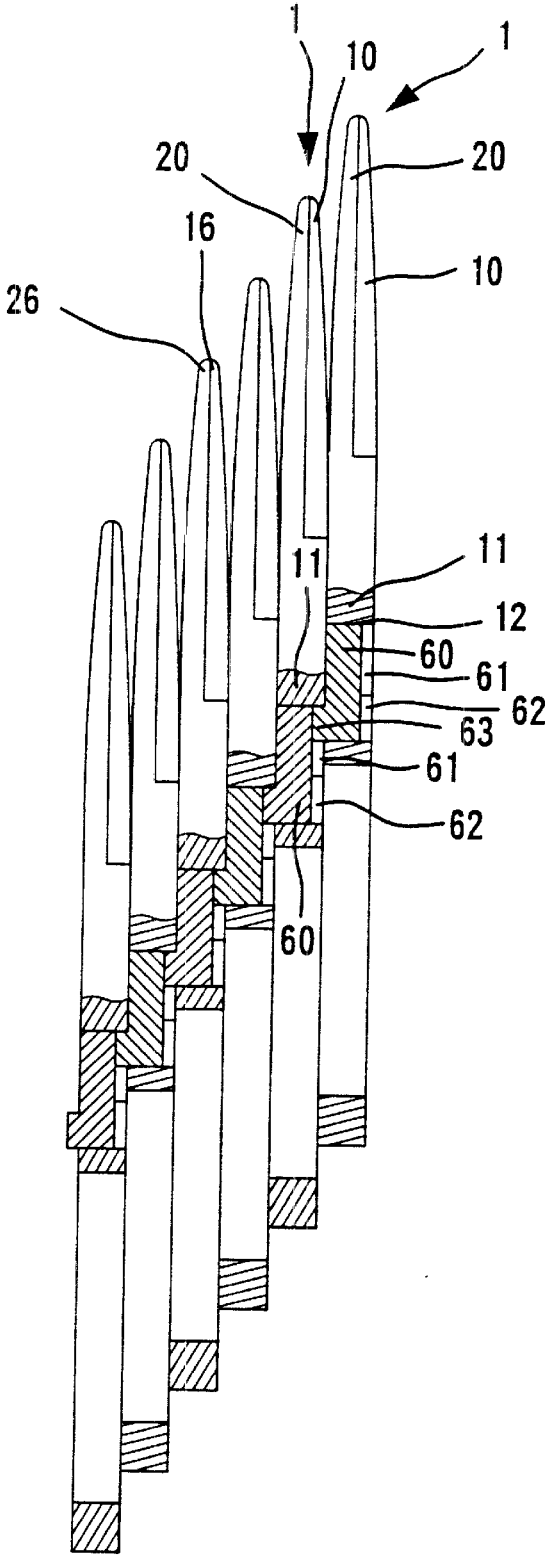
FIG. 14 is a side view similar to FIG. 13, wherein the tips of scissors are aligned along an inclined line and located at different levels.

When engaging one pair of scissors 1 with another pair of scissors 1, the dovetail block 63 of each connecting block 60 of one pair of scissors 1 is inserted into the insertion groove 62 of the respective connecting block 60 of another pair of scissors 1, as shown in FIG. 13. Then, the right one of two adjacent pairs of scissors 1 may be moved upward relative to the left one of the two adjacent pairs of scissors I until the dovetail block 63 of each connecting block 60 of the right one of the two adjacent pairs of scissors 1 are engaged with and thus retained in the dovetail engaging section 65 of the respective connecting block 60 of the left one of the two adjacent pairs of scissors 1, thereby forming a hairdressing scissor assembly shown in FIG. 14, in which the tips 16 and 26 of the hairdressing scissors 1 are aligned along an inclined line and located at different levels.

According to the above description, it is appreciated that the hairdressing scissors 1 in accordance with the present invention can be releasably engaged with one another to form a hairdressing scissor assembly with the tips of the scissors located at the same level or different levels to proceed with different haircutting functions.

Although the invention has been explained in relation to its preferred embodiment, it is to be understood that many other possible modifications and variations can be made without departing from the scope of the invention as hereinafter claimed.

What is claimed is:

1. A pair of hairdressing scissors comprising:

a first cutting member and a second cutting member pivotally connected together, the first cutting member comprising a first handle at a first end thereof and a first blade at a second end thereof, the second cutting member comprising a second handle at a first end thereof and a second blade at a second end thereof, a through-hole being defined in at least one of the first handle and the second handle; and a connecting block securely mounted in the through-hole, the connecting block comprising a dovetail groove in a first side thereof and a dovetail block in a second side thereof;

the dovetail block of the connecting block of said pair of hairdressing scissors being releasably engaged with a dovetail groove of a connecting block of a pair of similarly constructed hairdressing scissors.

2. The pair of hairdressing scissors as claimed in claim 1, wherein the dovetail groove comprising a dovetail engaging section and an insertion section located below the dovetail engaging section and having a width the same as a maximum width of the dovetail engaging section, the dovetail block being formed on an upper end of the second side of the connecting block.

3. The pair of hairdressing scissors as claimed in claim 2, wherein each of the first blade and the second blade has a tip, and wherein the tips of the pairs of hairdressing scissors that are engaged with each other are aligned along a straight line and located at the same level.

4. The pair of hairdressing scissors as claimed in claim 1, wherein the dovetail groove comprises a dovetail engaging section and an insertion section located above the dovetail engaging section and having a width the same as a maximum width of the dovetail engaging section, the dovetail block being formed on a lower end of the second side of the connecting block.

5. The pair of hairdressing scissors as claimed in claim 4, wherein each of the first blade and the second blade has a tip, and wherein the tips of the pairs of hairdressing scissors that are engaged with each other are aligned along an inclined line and located at different levels.

6. A pair of hairdressing scissors comprising:

a first cutting member and a second cutting member pivotally connected together, the first cutting member comprising a first handle at a first end thereof and a first blade at a second end thereof, the second cutting member comprising a second handle at a first end thereof and a second blade at a second end thereof, a through-hole being defined in at least one of the first handle and the second handle; and a connecting block securely mounted in the through-hole, the connecting block comprising a dovetail groove in a first side thereof and two dovetail blocks in a second side thereof, the first side of the connecting block further comprising two spaced transverse grooves intersecting with the dovetail groove, thereby dividing the dovetail groove into a first engaging section, a first insertion section, a second engaging section, a second insertion section, and a third engaging section in sequence;

the dovetail blocks of the connecting block of said pair of hairdressing scissors being releasably engaged with a dovetail groove of a connecting block of a pair of similarly constructed hairdressing scissors by means of respectively inserting the dovetail blocks of said pair of hairdressing scissors into a first insertion section and a second insertion section of the connecting block of said pair of similarly constructed hairdressing scissors and then moving the dovetail blocks of the connecting block of said pair of hairdressing scissors into one of a first position and a second position, wherein when in the first position, the dovetail blocks of said pair of hairdressing scissors are respectively engaged with the first engaging section and the second engaging section of the connecting block of said pair of similarly constructed hairdressing scissors such that tips of the first blade and the second blade are aligned along a straight line and located at the same level, and wherein when in the second position, the dovetail blocks of said pair of hairdressing scissors are respectively engaged with the second engaging section and the third engaging section of the connecting block of said pair of similarly constructed hairdressing scissors such that tips of the first blade and the second blade are aligned along an inclined line and located at different levels.

* * * * *